United States Patent [19]

Monk

[11] 4,195,405

[45] Apr. 1, 1980

[54] COMBINED MITTEN AND GLOVE

[75] Inventor: Lilly Monk, Mount Royal, Canada

[73] Assignee: Paris Glove of Canada Ltd., Montreal, Canada

[21] Appl. No.: 20,862

[22] Filed: Mar. 15, 1979

[51] Int. Cl.[2] ..... A41D 19/00

[52] U.S. Cl. ..... 2/158

[58] Field of Search ..... 2/158, 159, 66, 164

[56] References Cited

U.S. PATENT DOCUMENTS

| | | | |
|---|---|---|---|
| 2,603,790 | 7/1952 | Boehm-Myro | 2/158 |
| 2,840,832 | 7/1958 | Kifa | 2/158 |

FOREIGN PATENT DOCUMENTS

| | | | |
|---|---|---|---|
| 794752 | 12/1935 | France | 2/158 |

*Primary Examiner*—Doris L. Troutman

*Attorney, Agent, or Firm*—Robert E. Mitchell; Thomas J. Greer, Jr.

[57] ABSTRACT

A mitten having a capability of being used as a glove which includes a knitted, elongated, tubular member having one end closed and formed with elongated finger and thumb portions forming a glove. A waisted wrist portion is connected to the glove, and a tubular mitten portion extends from the wrist portion in the opposite direction. The mitten is open at its free end with an overlapping flap covering the free end and a thumb portion formed in the mitten portion such that when the glove is worn, the mitten portion can be folded over the glove with the thumb of the mitten portion coinciding with the thumb portion of the glove and the overlapped portion covering the opening at the end of the tubular mitten over the fingers.

3 Claims, 9 Drawing Figures

COMBINED MITTEN AND GLOVE

BACKGROUND OF THE INVENTION

1. Field of the Invention

The present invention relates to a combined mitten and glove, and more particularly, to a one-piece knitted glove with a mitten adapted to completely cover the glove or be retracted therefrom.

2. Description of the Prior Art

Certain developments in combined mittens and gloves have been made, for example, as illustrated in U.S. Pat. No. 2,323,136, Johanson, June 29, 1943; U.S. Pat. No. Des. 128,999, Rhea, Aug. 19, 1941; and German Pat. No. 669,607, 1938. These examples of such combined mittens and gloves, however, have the disadvantage that when the apparel is worn as a glove, the retractable parts of the mitten are cumbersome and are not out of the way.

SUMMARY OF THE INVENTION

It is an aim of the present invention to provide a combined mitten and glove which is a simple one-piece construction and can be easily manufactured in a single blank and which can be worn either as a glove or as a mitten, and when worn as a glove, has the appearance of a simple glove without a dependent mitten portion.

A construction according to the present invention comprises a knitted elongated tubular member, one end being closed and having elongated finger and thumb portions forming a glove, a waisted wrist portion connected to the glove and a tubular mitten portion extending from the wrist portion in the opposite direction, the mitten being open at its free end with an overlapping flap covering the free end and a thumb portion formed in the mitten portion such that when the glove is worn, the mitten portion can be folded over the glove with the thumb of the mitten portion coinciding with the thumb portion of the glove and the overlapped portion covering the opening at the end of the tubular mitten over the fingers.

The combined mitten and glove, when worn as a glove, would normally have the elongated extending tubular portion forming the mitten being folded along its tubular length to the wrist portion forming a cuff for the glove.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 1:
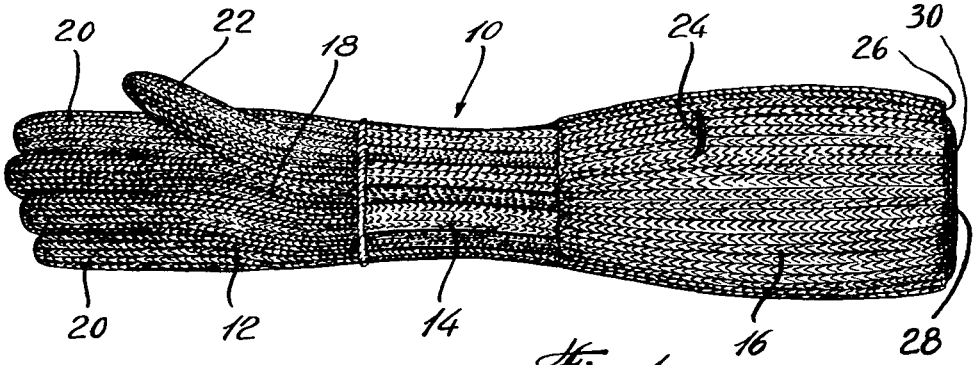
FIG. 1 is a plan view of the combined mitten and glove in its elongated blank form.
Figure 5:
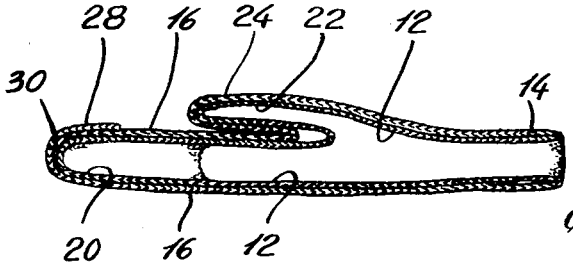
FIG. 5 is a longitudinal cross-section taken along line 5—5 of FIG. 2.
Figure 9:
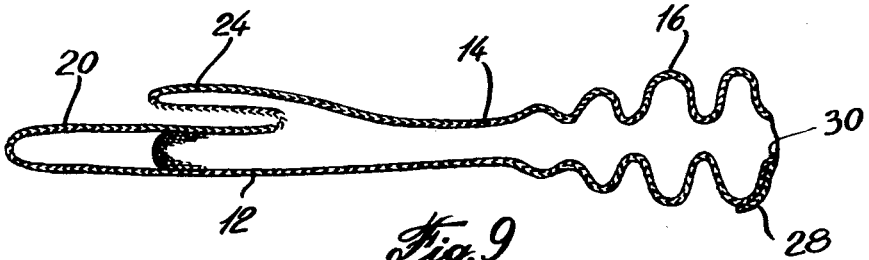
FIG. 9 is a cross-section of the full tubular blank of the combined mitten and glove.

Referring now to the drawings and particularly to FIGS. 1 and 9, there is shown a glove 10 of knitted construction having a first glove portion 12, a wrist portion 14 and a depending tubular mitten portion 16.

The glove portion has a palm 18, four depending tubular finger members 20 and a depending tubular thumb member 22. The wrist portion 14 is shown in FIG. 1 and is stitched such that a certain amount of elasticity is provided, but when it is not being stretched laterally, it is the narrowest portion of the tubular blank.

The tubular mitten portion forms part of the single blank and includes, when in the tubular blank form of FIG. 1, a tubular depending thumb 24 which extends inwardly of the tube. The tubular mitten portion is provided with an open end 26 covered by an overlapping flap 28. The juncture of the flap with one edge of the opening in the tube can be provided with a stitched elastic band 30 for crimping and forming the tapered end of the mitten.

Figure 6:
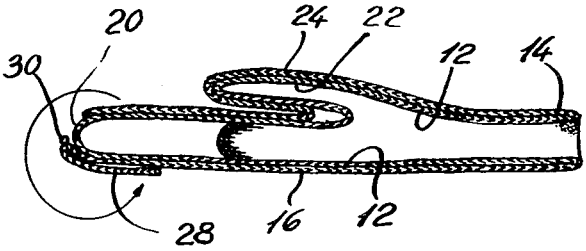
FIG. 6 is a cross-section similar to FIG. 2 showing a first step in the uncovering of the glove by folding back the tubular portion forming the mitten.
Figure 2:
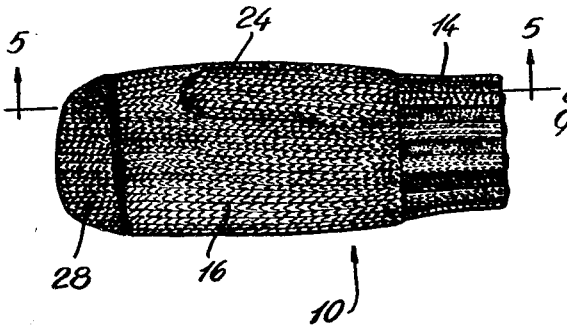
FIG. 2 is a plan view showing the combined mitten and glove as it would be worn as a mitten.
Figure 3:
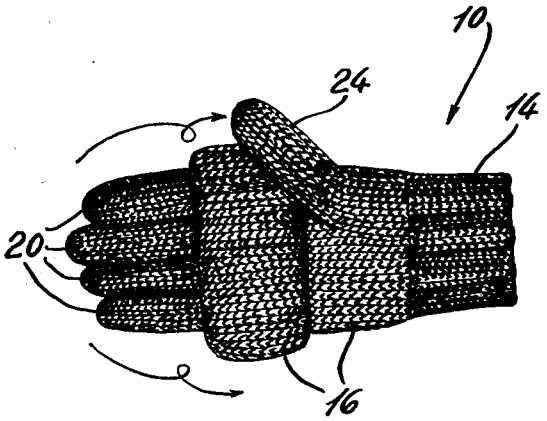
FIG. 3 shows the combined mitten and glove of FIG. 2 with the mitten portion being folded rearwardly longitudinally to uncover the glove.
Figure 4:
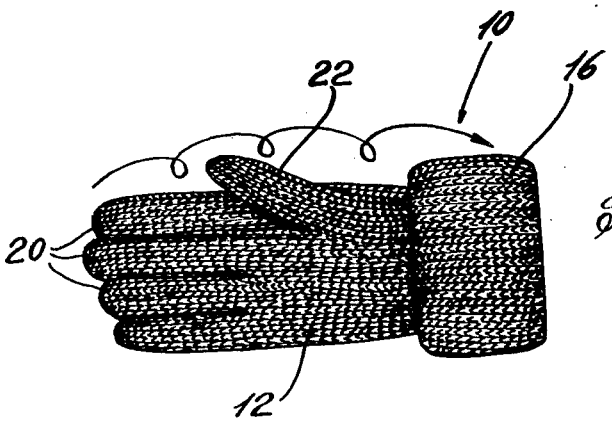
FIG. 4 is a plan view of the combined mitten and glove in a glove condition with the tubular mitten portion forming the cuff at the wrist portion.
Figure 7:
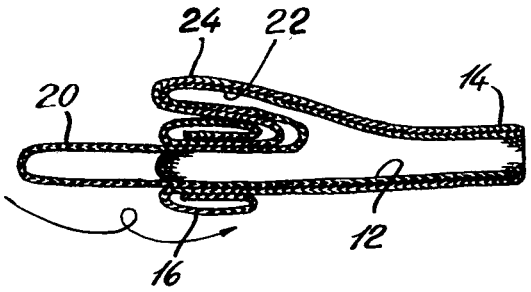
FIG. 7 is a similar cross-sectional view showing the tubular mitten portion being folded back a further step to uncover the glove.
Figure 8:
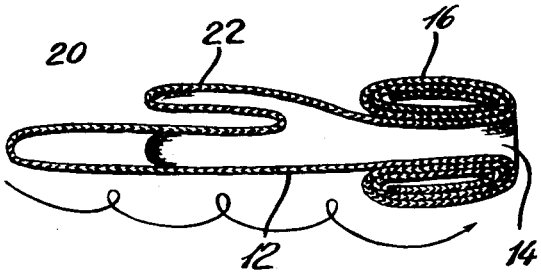
FIG. 8 is a similar cross-section with the tubular portion of the mitten fully pulled back over the wrist portion similar to FIG. 4.

In operation, the tubular depending portion 16 would be folded down over the glove portion 12 as shown in FIG. 2, with the overlapping flap 28 covering the openings at the end of the tubular mitten portion 16 and the thumb 24 covering the thumb 22 of the glove 12. If it is required to wear the apparel as a glove, the glove would be uncovered by following the step sequences of FIGS. 3 and 4 and more specifically illustrated in FIGS. 5 through 8. Following the sequences of FIGS. 5 through 8, it is shown in FIG. 6, for instance, that the overlapping flap 28 is first folded back uncovering the opening at the end of the tubular mitten portion and allowing the fingers 20 to project therefrom, the tubular mitten portion is folded back further as shown in FIG. 7, and eventually the thumb 24 is removed from the thumb 22 and the tubular mitten member 16 is folded back longitudinally to a position shown in FIG. 8 where it forms a neat cuff at the wrist portion 14 displaying the gloved hand.

I claim:

1. A combined mitten and glove, including an elongated tubular member including at one end of the tube a closed glove with finger and thumb portions extending therefrom, a waisted wrist portion connected to the glove and a tubular mitten portion extending from the wrist portion in the opposite direction, the mitten being open at its free end with an overlapping flap covering the free end, and a thumb portion formed in the mitten portion such that when the glove is worn, the mitten portion can be folded over to cover the glove portion with the thumb of the mitten portion coinciding with the thumb portion of the glove portion, and the overlapped flap covering the opening at the end of the tubular mitten over the fingers.

2. A combined mitten and glove as defined in claim 1, wherein an elastic is woven at the juncture of the overlapped flap and the end of the mitten portion such as to crimp and taper the end of the mitten when it is covering the glove.

3. A combined mitten and glove as defined in claim 1, wherein the tubular mitten portion can be folded back to reveal the glove while the tubular mitten portion is folded to form a cuff at the wrist portion of the tube.

* * * * *